US012690725B1

(12) United States Patent
Twedt

(10) Patent No.: US 12,690,725 B1
(45) Date of Patent: Jul. 28, 2026

(54) SOAP-HOLDING APPARATUS WITH DUAL POCKETS

(71) Applicant: Donald Twedt, Lake Elmo, MN (US)

(72) Inventor: Donald Twedt, Lake Elmo, MN (US)

( * ) Notice: Subject to any disclaimer, the term of this patent is extended or adjusted under 35 U.S.C. 154(b) by 0 days.

(21) Appl. No.: 19/256,140

(22) Filed: Jun. 30, 2025

(51) Int. Cl.
*A47K 7/03* (2006.01)
*A47K 5/04* (2006.01)
*A47L 13/18* (2006.01)

(52) U.S. Cl.
CPC ..... *A47K 7/03* (2013.01); *A47K 5/04* (2013.01); *A47L 13/18* (2013.01)

(58) Field of Classification Search
CPC .... A47K 7/02; A47K 7/03; A47K 5/05; A47L 13/17; A47L 13/19; A47L 13/16; A47L 13/18; A41D 13/08
USPC ..... D3/303; 401/201; 15/208–210.1, 227
See application file for complete search history.

(56) References Cited

U.S. PATENT DOCUMENTS 2,119,895 A * 6/1938 Sutton ..... A47K 7/02 383/44
2,569,067 A * 9/1951 Livshin ..... A47K 7/03 401/6
2,607,940 A * 8/1952 Miller ..... A47K 5/04 383/117
2,668,309 A * 2/1954 Colgan ..... A47K 7/03 401/7
4,457,640 A * 7/1984 Anderson ..... A47K 7/03 15/104.94
4,789,262 A * 12/1988 Sanchez ..... A47K 7/03 401/201
4,796,751 A * 1/1989 Madkour ..... G02C 13/006 206/812
5,108,642 A 4/1992 Aszman et al.
6,065,177 A * 5/2000 Chien ..... A45C 7/00 D28/63
8,061,919 B2 * 11/2011 Alarcon Grajeda ..... A47K 7/03 15/244.4
9,044,121 B2 * 6/2015 Phillips ..... A47K 7/02
9,220,378 B2 12/2015 Urban
9,333,151 B2 5/2016 Smith, III et al.
9,622,636 B1 4/2017 Taylor
10,357,441 B2 7/2019 McConaughy et al.
12,096,893 B2 9/2024 Neal
2003/0198501 A1 10/2003 Dawan
2010/0287720 A1 11/2010 Kayata, Sr. et al.
2013/0098381 A1 4/2013 McBrayer
2013/0170890 A1 7/2013 Urban
(Continued)

FOREIGN PATENT DOCUMENTS

CA 2007694 A1 7/1990
FR 1190521 A 10/1959

*Primary Examiner* — Laura C Guidotti
(74) *Attorney, Agent, or Firm* — Lund IP, PLLC

(57) ABSTRACT

A soap-holding apparatus includes a washcloth folded to form a front half and a back half connected by a first fold, a left flap formed by a second fold, a right flap formed by a third fold, and a front flap formed by a fourth fold. A first pocket configured to hold a bar of soap is formed by the front half, left flap, right flap, and front flap. A second pocket configured to receive a user's hand is formed between the front half and the back half. The front half completely separates the first pocket from the second pocket, forming two distinct compartments. A stitch secures the left flap, right flap, and front flap together.

16 Claims, 8 Drawing Sheets

(56) References Cited

U.S. PATENT DOCUMENTS

| | | | |
|---|---|---|---|
| 2014/0059794 | A1 | 3/2014 | Phillips |
| 2015/0020335 | A1 | 1/2015 | Soutullo et al. |
| 2015/0190017 | A1 | 7/2015 | McBrayer |
| 2016/0095476 | A1 | 4/2016 | Morgan |
| 2017/0112347 | A1 | 4/2017 | Taylor |
| 2017/0181934 | A1 | 6/2017 | Khamis et al. |
| 2017/0188757 | A1 | 7/2017 | Marsh |
| 2022/0039612 | A1 | 2/2022 | Briscoe |
| 2023/0090471 | A1 | 3/2023 | Neal |
| 2024/0057824 | A1 | 2/2024 | Rogers |

* cited by examiner

SOAP-HOLDING APPARATUS WITH DUAL POCKETS

TECHNICAL FIELD

The disclosure is related to personal hygiene devices, and more particularly to washing with a bar of soap.

BACKGROUND OF THE INVENTION

Personal hygiene practices have long included the use of soap for cleansing the body. Bar soap remains a popular choice for many individuals due to its simplicity, affordability, and effectiveness.

SUMMARY OF THE INVENTION

In one example, a soap-holding apparatus formed from a folded washcloth comprises a front wall, a back wall, a middle wall disposed between the front wall and the back wall. The front wall, the back wall and the middle wall are configured to form a first pocket configured to hold a bar of soap, and a second pocket configured to receive a user's hand. The front wall, the back wall and the middle wall are formed by folding and stitching portions of the washcloth.

In another example, this disclosure is directed towards a soap-holding apparatus comprising a front wall, a back wall, a middle wall disposed between the front wall and the back wall, and at least one side wall connecting the front wall, back wall, and middle wall. The front wall, the back wall and the middle wall are configured to form a first pocket configured to hold a bar of soap, and a second pocket configured to receive a user's hand.

In a further example, this disclosure is directed towards a soap-holding apparatus comprising a washcloth folded to form a front half and a back half connected by a first fold, a left flap formed by a second fold, a right flap formed by a third fold, a front flap formed by a fourth fold, a first pocket configured to hold a bar of soap, the first pocket formed by the front half, left flap, right flap, and front flap, a second pocket configured to receive a user's hand, the second pocket formed between the front half and the back half, and a stitch securing the left flap, right flap, and front flap together.

DETAILED DESCRIPTION OF THE INVENTION

Using bar soap can present certain challenges during bathing or showering. One common issue is the tendency for bar soap to become slippery when wet, making it difficult to grip and potentially leading to dropping or losing the soap. This can be particularly problematic for individuals with limited dexterity or mobility. Additionally, as bar soap is used over time, it often reduces in size, becoming even more challenging to handle effectively.

Figure 1A:
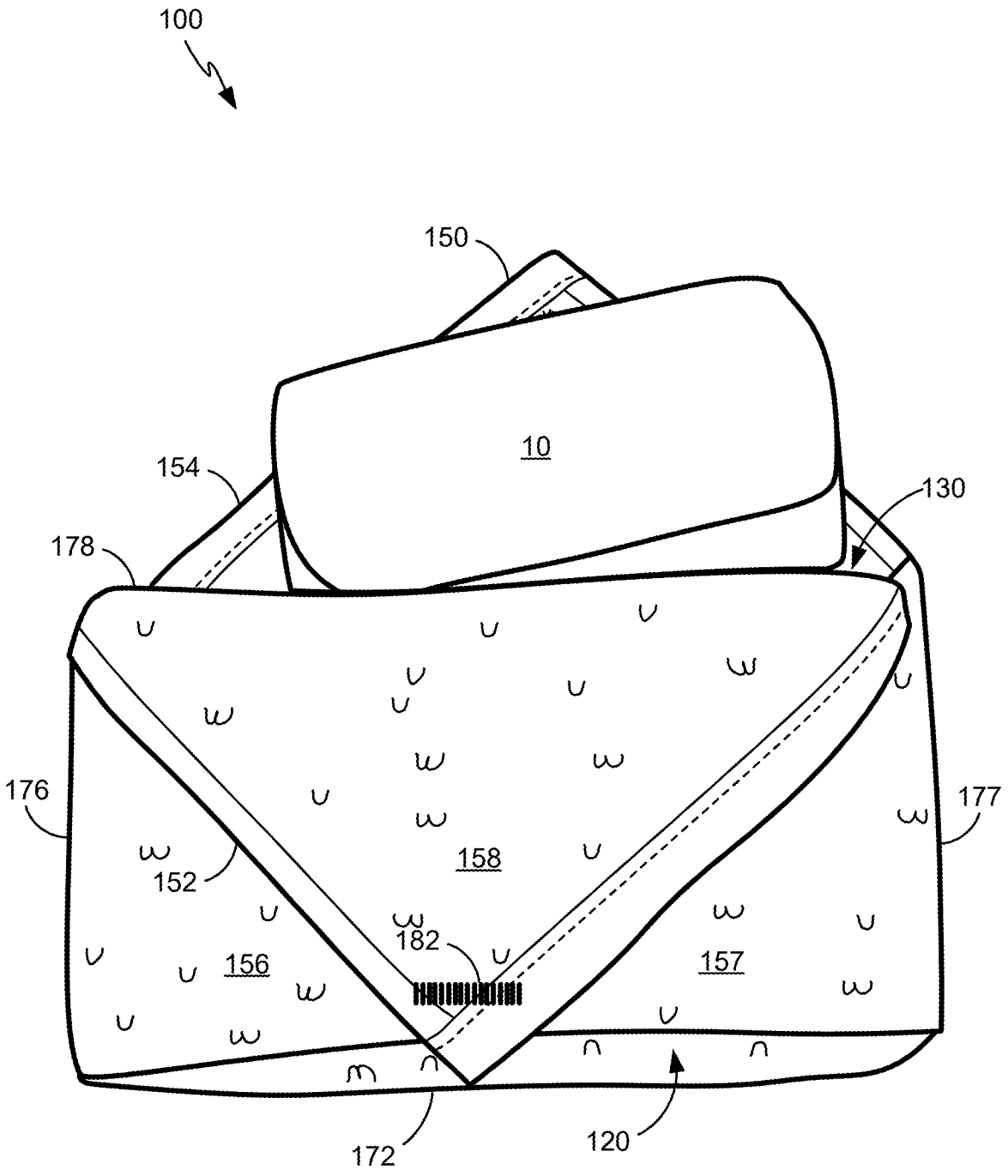
FIG. 1A illustrates an orthogonal view of a soap-holding apparatus formed from a folded washcloth.

The soap-holding apparatus 100 may be formed from a folded washcloth 150. FIG. 1A illustrates an orthogonal view of the soap-holding apparatus 100. The soap-holding apparatus 100 may include a first pocket 120 and a second pocket 130. In some cases, the first pocket 120 may be configured to hold a bar of soap 10. The second pocket 130 may be configured to receive a user's hand.

The soap-holding apparatus 100 may comprise a front half 152 and a back half 154. In some implementations, the front half 152 and the back half 154 may be formed by a first fold 172 of the washcloth 150. The soap-holding apparatus 100 may further include a left flap 156 and a right flap 157, which may be formed by a second fold 176 and a third fold 177, respectively. A front flap 158 may be created by a fourth fold 178.

Figure 1B:
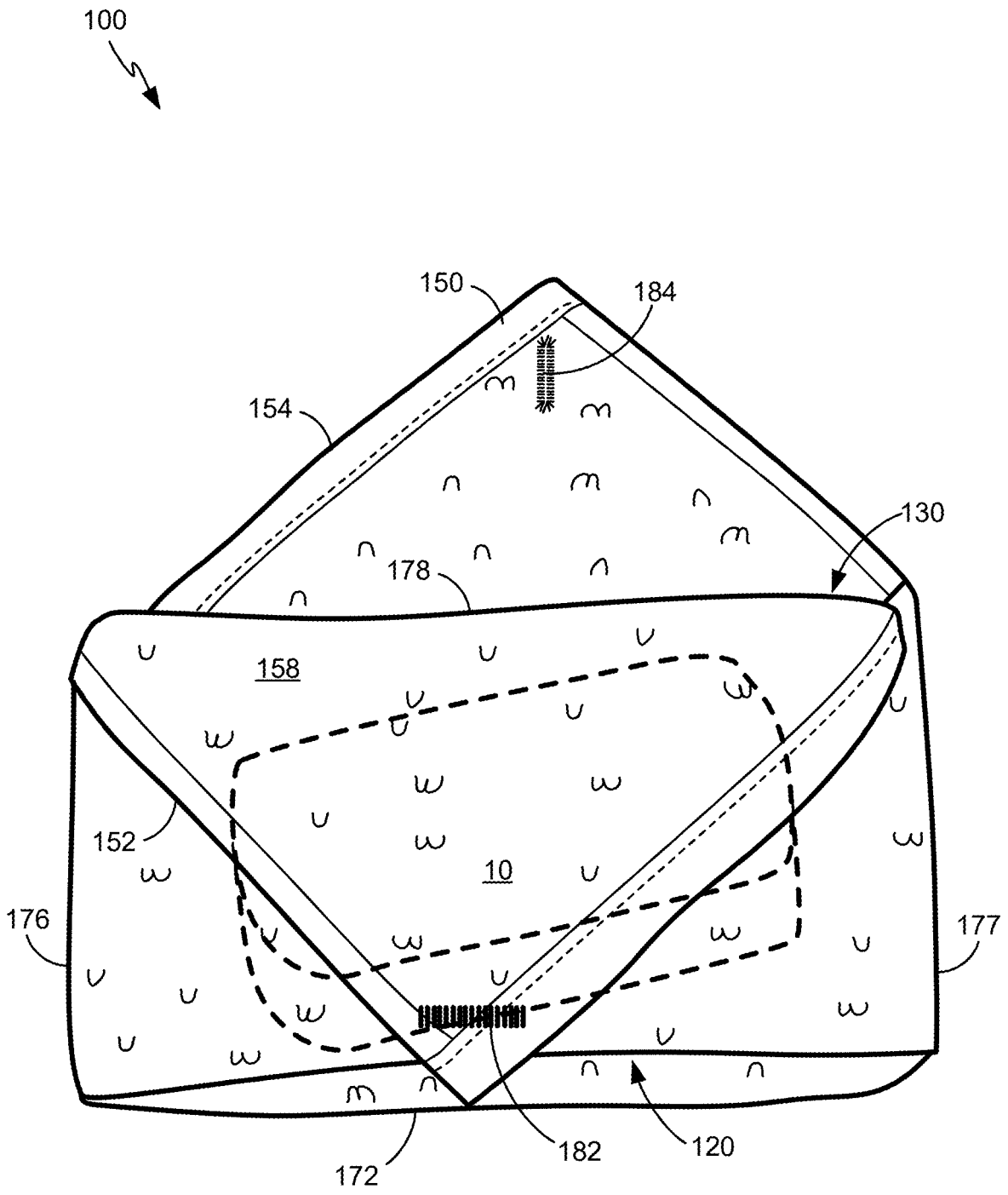
FIG. 1B illustrates another orthogonal view of the soap-holding apparatus of FIG. 1A.

FIG. 1B shows another orthogonal view of the soap-holding apparatus 100. As illustrated in FIG. 1B, the left flap 156, right flap 157, and front flap 158 may be secured together by a stitch 182. This configuration may form the first pocket 120 and the second pocket 130.

The soap-holding apparatus 100 may include a permeable material forming at least a portion of the first pocket 120. The permeable material may allow water and soap to pass through during use. In some cases, the permeable material may be the material of the washcloth 150 itself.

The structure of the soap-holding apparatus 100 may provide several benefits. The first pocket 120 may securely hold the bar of soap 10, reducing the likelihood of dropping or losing the soap during use. The second pocket 130 may allow a user to insert their hand, providing a secure grip and facilitating the application of soap. The permeable nature of the material may allow for effective lathering and rinsing while using the apparatus.

The soap-holding apparatus 100 may be used in various ways to facilitate washing and bathing. In some cases, a user may insert a bar of soap 10 into the first pocket 120 of the soap-holding apparatus 100. The permeable material forming at least a portion of the first pocket 120 may allow water and soap to pass through during use, enabling effective lathering.

To use the soap-holding apparatus 100, a user may insert their hand into the second pocket 130. This configuration may allow the user to securely grip and control the apparatus 100 while washing. The user may then apply the soap-holding apparatus 100 to their body, using the bar of soap 10 contained within the first pocket 120 to create lather and cleanse the skin.

In some cases, the soap-holding apparatus 100 may be particularly useful for individuals with limited dexterity or mobility. The secure containment of the bar of soap 10 within the first pocket 120 may reduce the risk of dropping or losing the soap during use. Additionally, the soap-holding apparatus 100 may allow users to continue using smaller pieces of soap that might otherwise be difficult to handle.

For proper care and maintenance of the soap-holding apparatus 100, users may rinse the apparatus thoroughly after each use to remove any remaining soap residue. In some cases, the soap-holding apparatus 100 may be hung to dry using a reinforced hole 184 near an upped edge of back half 154. The reinforced hole 184 for hanging the apparatus may have a diameter of approximately 0.5 to 5 cm, allowing for easy hanging on standard bathroom hooks or fixtures. This may help prevent the accumulation of moisture and extend the life of both the apparatus and the bar of soap 10.

The washcloth 150 used to form the soap-holding apparatus 100 may be machine washable, allowing for easy cleaning when necessary. In some cases, users may remove the bar of soap 10 from the first pocket 120 before washing the apparatus 100 to prevent excessive soap loss during the cleaning process.

The soap-holding apparatus 100 may be particularly useful in various scenarios. For example, it may be used in shared shower facilities, such as gyms or dormitories, where users may prefer to keep their soap contained and easily transportable. The apparatus 100 may also be beneficial for outdoor activities like camping, where maintaining a grip on soap can be challenging.

In some cases, the soap-holding apparatus 100 may serve as an exfoliating tool. The texture of the washcloth 150 may provide gentle exfoliation while washing, potentially eliminating the need for separate exfoliating products or tools.

Users may adapt their washing techniques when using the soap-holding apparatus 100. For instance, they may use circular motions to create lather, or they may use the edges of the apparatus for more targeted cleaning in areas such as between toes or behind ears. The flexibility of the washcloth 150 may allow users to manipulate the apparatus 100 to suit their specific washing needs.

Figure 2A:
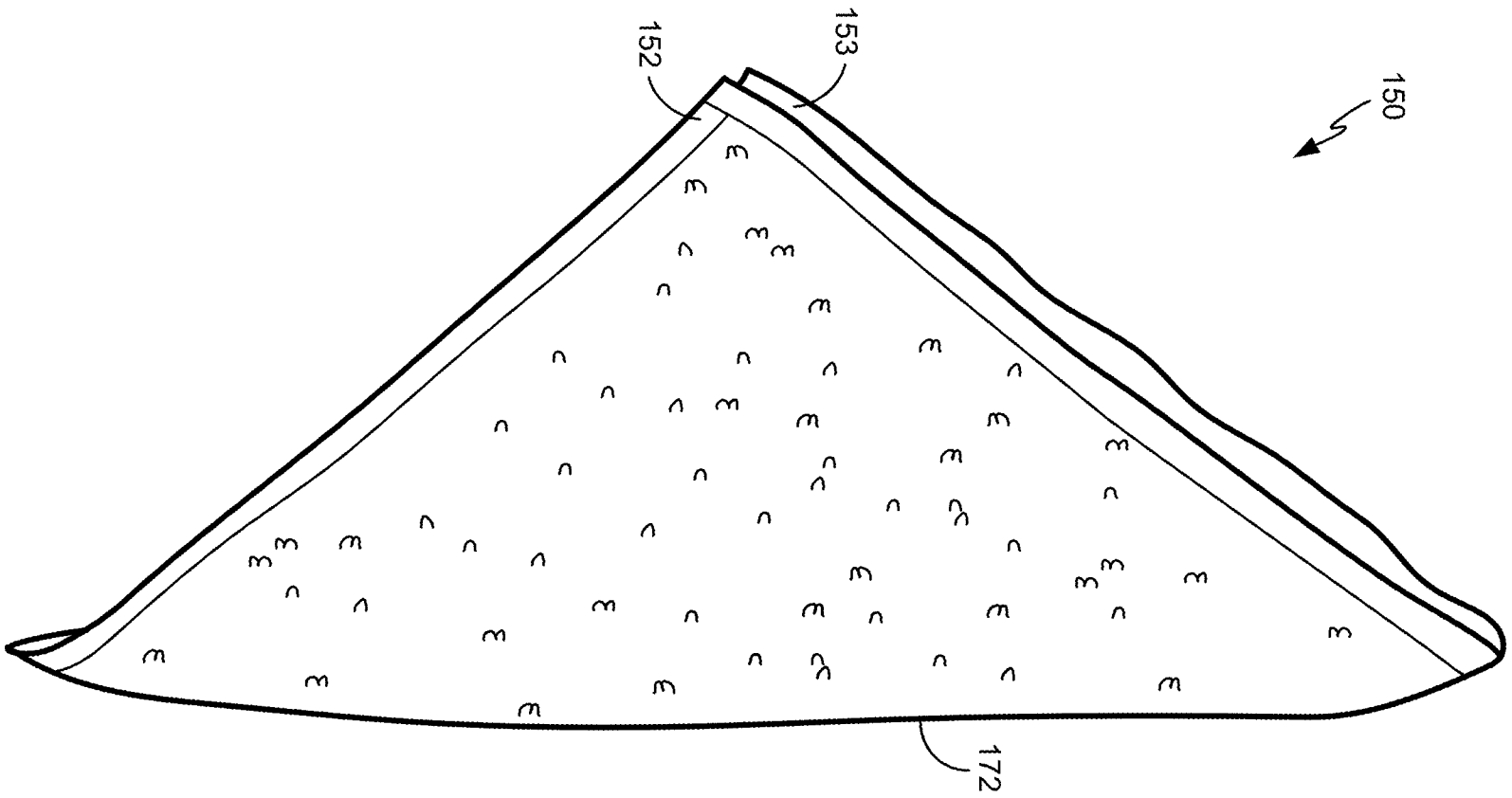
FIG. 2A-2C illustrates techniques for folding a washcloth to form the soap-holding apparatus of FIG. 1A.

The soap-holding apparatus 100 may be formed from a folded washcloth 150. FIG. 2A illustrates an orthogonal view of a first step in forming the soap-holding apparatus 100. The washcloth 150 may be folded along a first fold 172 to create a front half 152 and a back half 153.

Figure 2B:
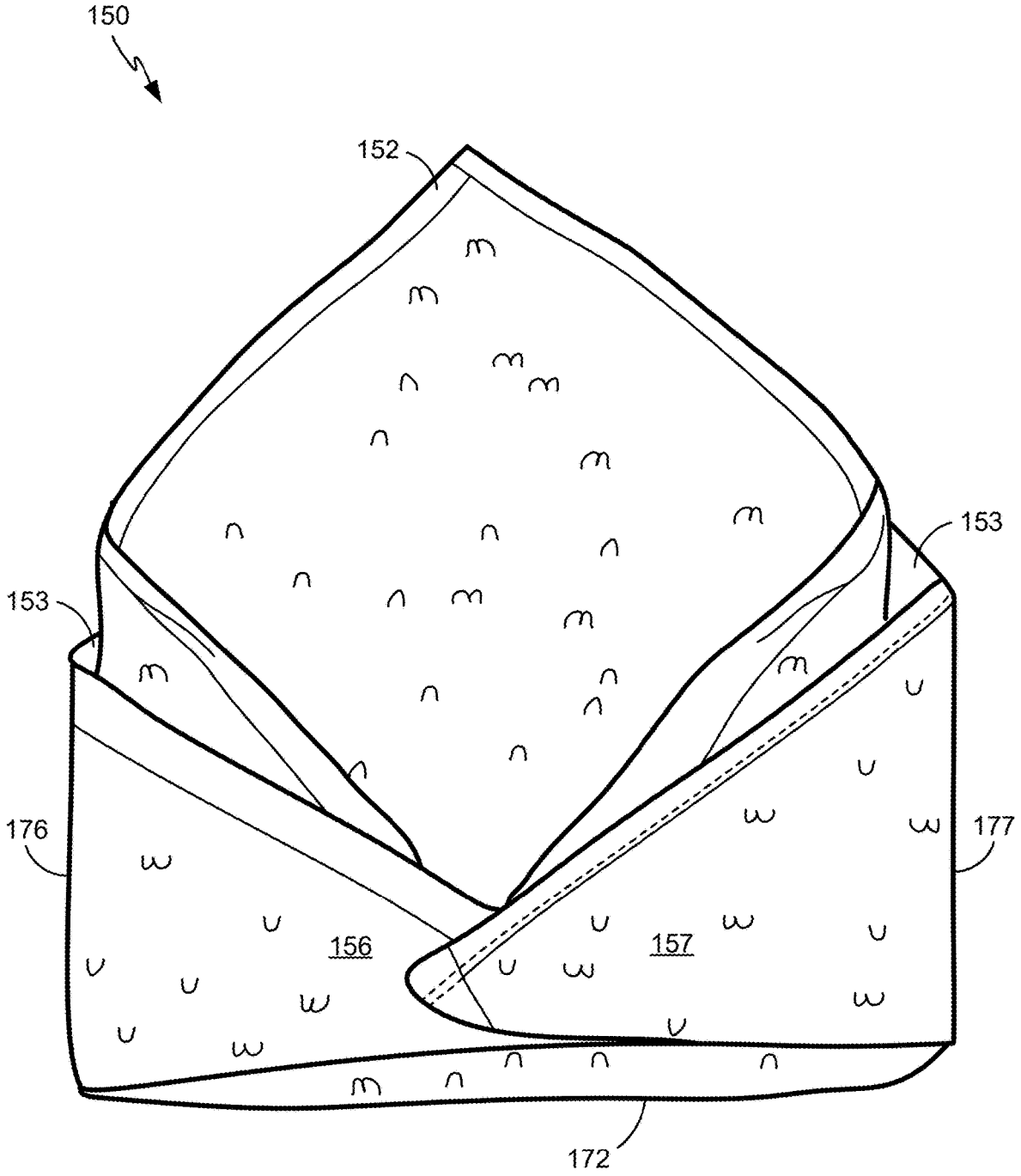

FIG. 2B shows the next step in the folding process. A second fold 176 may be made to form a left flap 156, and a third fold 177 may be made to form a right flap 157. These folds may contribute to creating the overall structure of the soap-holding apparatus 100.

Figure 2C:
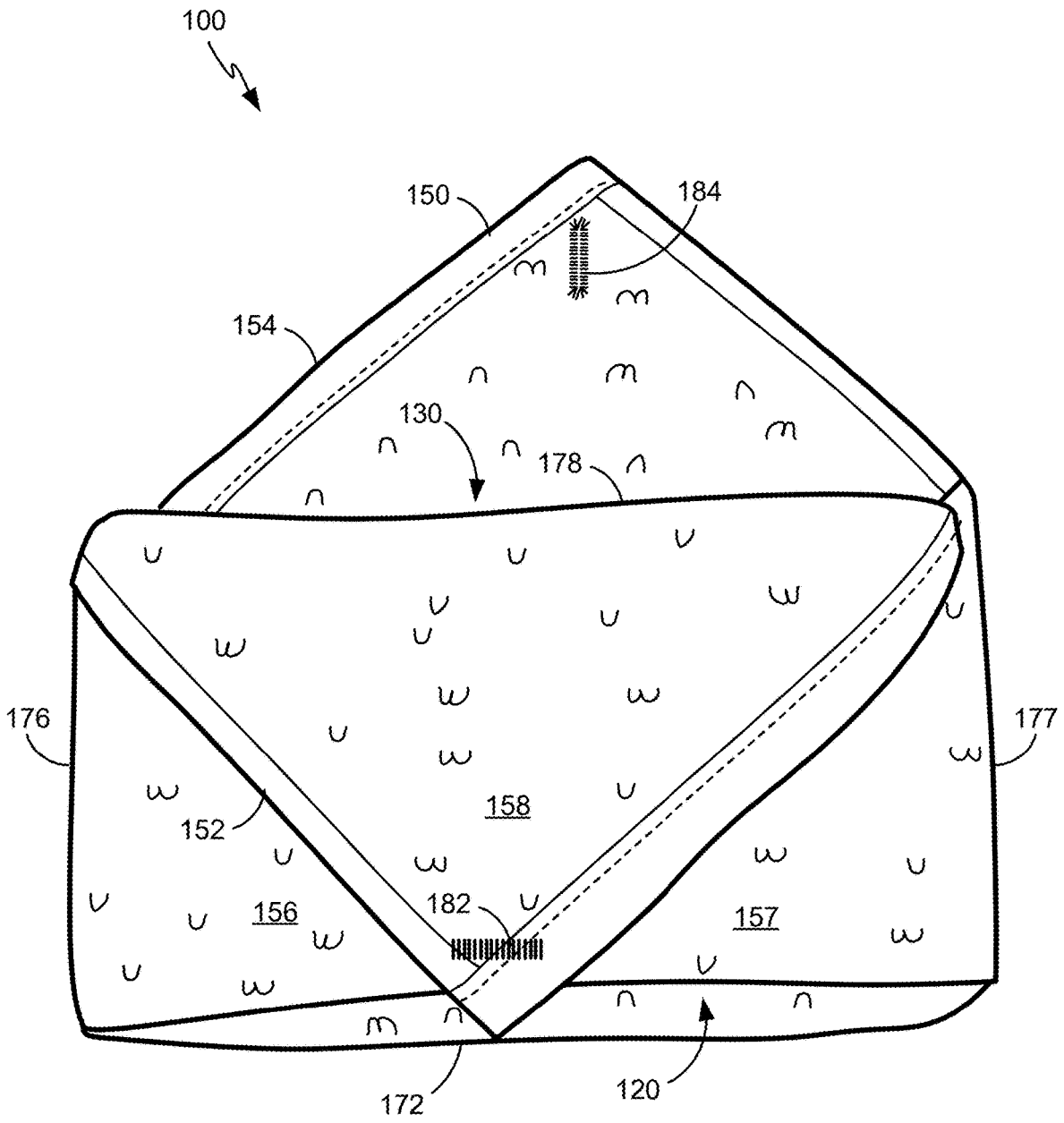

FIG. 2C illustrates the final folding step and the completion of the soap-holding apparatus 100. A fourth fold 178 may be made to form a front flap 158. The left flap 156, right flap 157, and front flap 158 may be secured together by a stitch 182. This configuration may result in the formation of a first pocket 120 and a second pocket 130.

In some cases, the first pocket 120 may be configured to hold a bar of soap, while the second pocket 130 may be designed to receive a user's hand. The folding and stitching of the washcloth 150 may create these distinct pockets, each serving a specific function in the soap-holding apparatus 100.

The structure of the soap-holding apparatus 100 may include a middle wall formed by the folded portions of the washcloth 150. This middle wall may be disposed between a front wall and a back wall of the apparatus 100. The front wall may correspond to the front half 152, while the back wall may correspond to the back half 153.

In some implementations, the soap-holding apparatus 100 may comprise at least one side wall connecting the front wall, back wall, and middle wall. The side wall may be formed by the folded edges of the washcloth 150, particularly where the left flap 156 and right flap 157 meet the front and back halves.

The folded configuration and stitching of the washcloth 150 may contribute to the overall functionality of the soap-holding apparatus 100. The multiple layers created by the folds may provide strength and durability to the structure, while the stitching may ensure that the pockets remain secure during use.

The permeable nature of the washcloth 150 material may allow water and soap to pass through the soap-holding apparatus 100 during use, facilitating effective lathering and cleaning. The folded structure may also provide a comfortable grip for the user when their hand is inserted into the second pocket 130.

In some implementations, the soap-holding apparatus 100 may be designed with specific dimensions to accommodate standard bar soap sizes and typical hand sizes. For example, the washcloth 150 may be approximately 10-15 inches on a side in a square or rectangular configuration.

Figure 3:
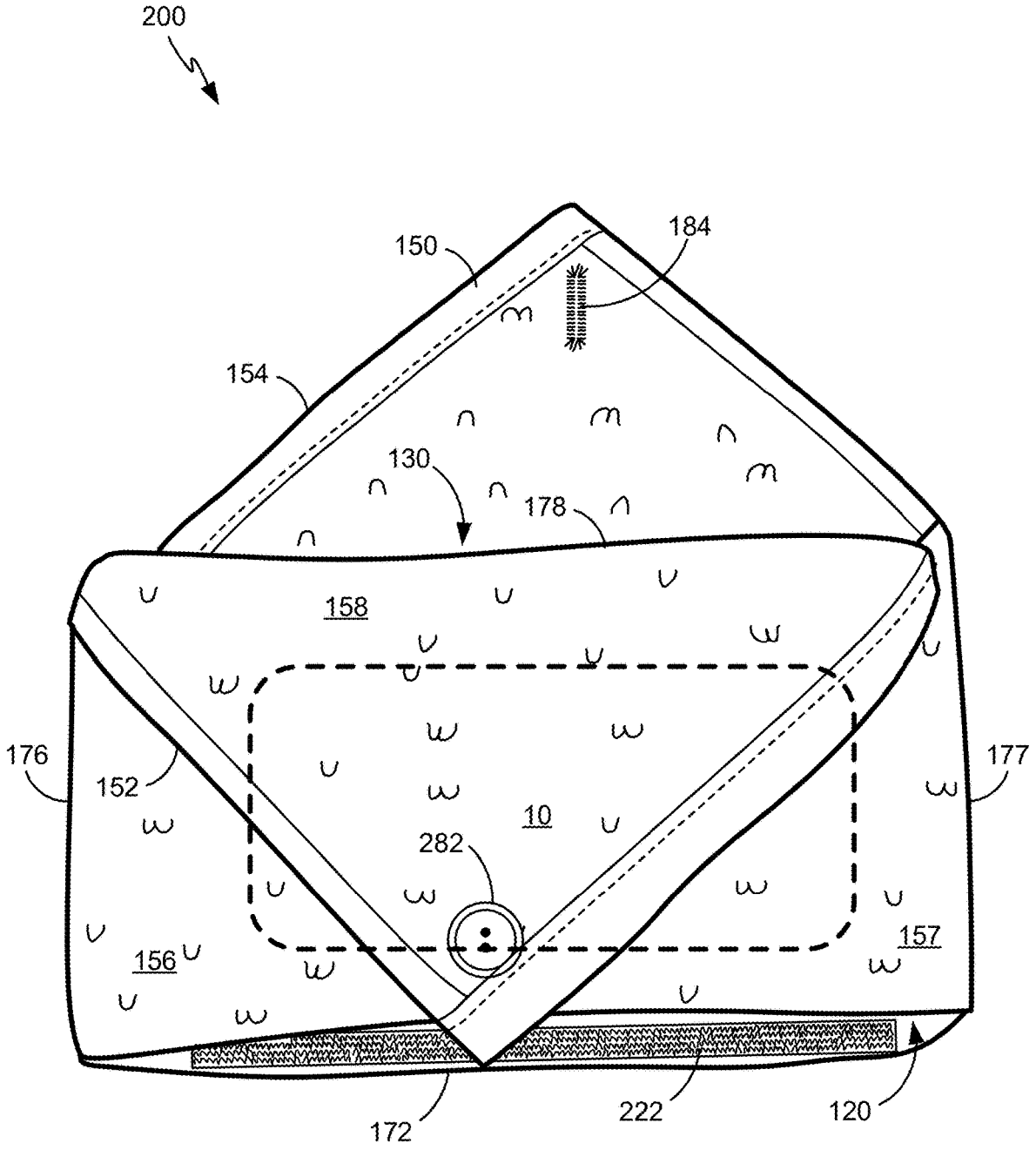
FIG. 3 illustrates a modified soap-holding apparatus.

The soap-holding apparatus 200 may include alternative configurations and additional features to enhance functionality and user experience. FIG. 3 illustrates an isometric view of the soap-holding apparatus 200, which may be substantially similar to the soap-holding apparatus 100 with some modifications.

In some cases, the soap-holding apparatus 200 may include a button 282 to secure the flaps 156, 157, and 158. The button 282 may provide an alternative closure mechanism to the stitch 182 used in the soap-holding apparatus 100. This configuration may allow for easier assembly and disassembly of the soap-holding apparatus 200, which may facilitate cleaning or replacement of components.

The soap-holding apparatus 200 may also include a hook and loop fastener 222. The hook and loop fastener 222 may allow for closure of the first pocket 120. This feature may be particularly useful for securing a bar of soap 10 within the first pocket 120 while hanging the soap-holding apparatus 200 from a reinforced hole 484. The reinforced hole 484 may be incorporated into the back wall of the soap-holding apparatus 200, providing a convenient means for storage and drying between uses.

Figure 4A:
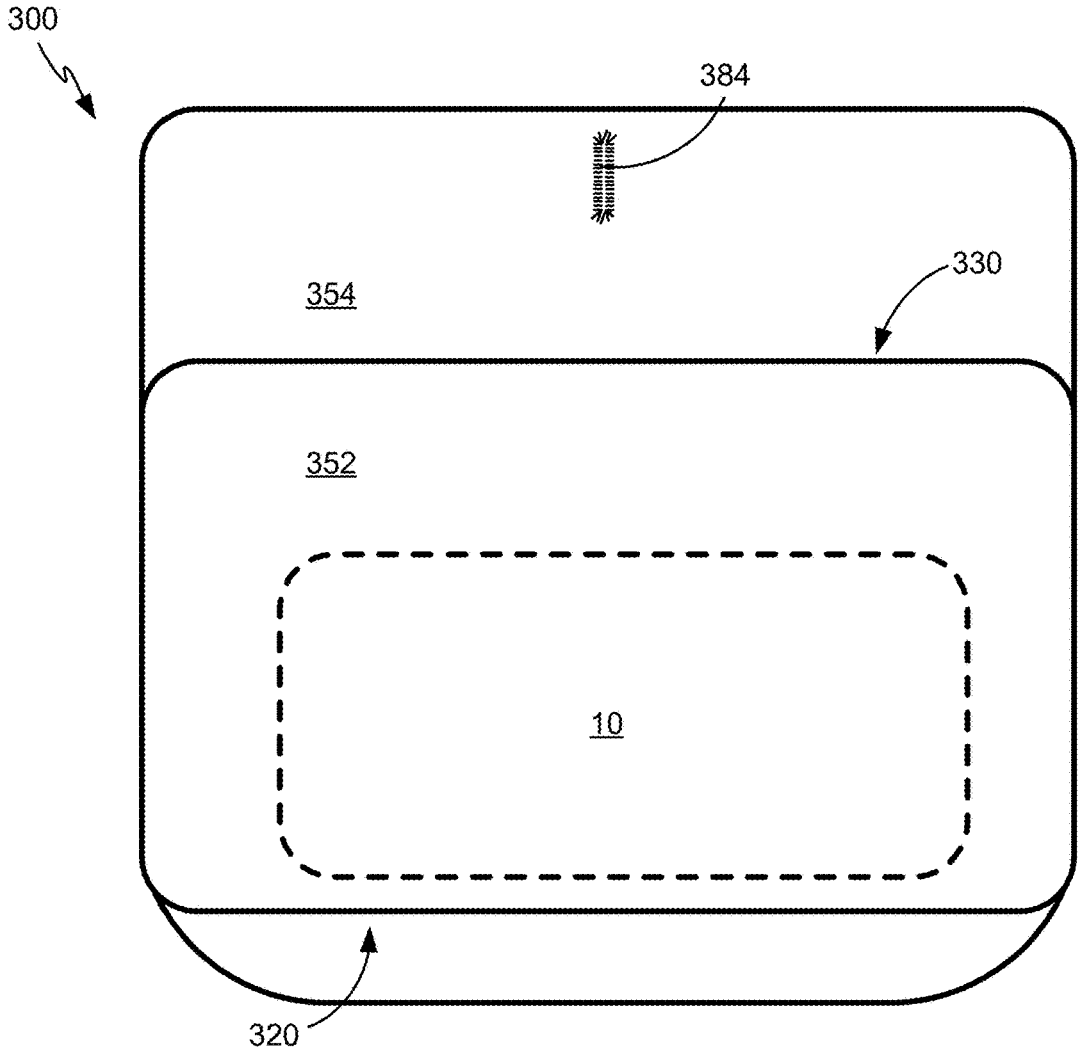
FIGS. 4A-4B illustrate an alternative soap-holding apparatus.
Figure 4B:
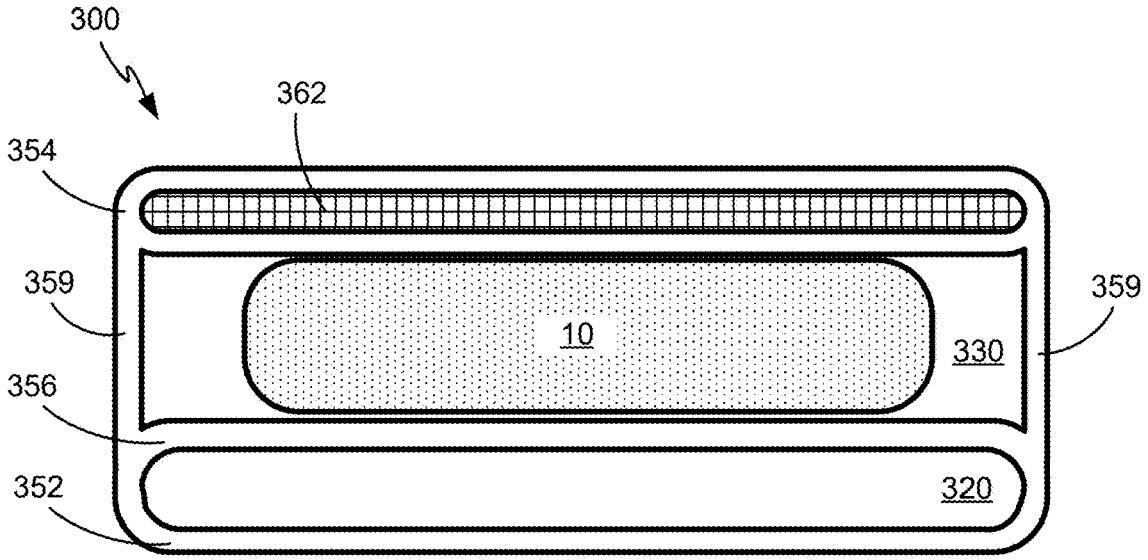

FIGS. 4A-4B illustrate orthogonal views of a soap-holding apparatus 300, which may represent an alternative configuration to the soap-holding apparatus 100 and the soap-holding apparatus 200. The soap-holding apparatus 300 may include a first pocket 320 and a second pocket 330. These pockets may be formed by a front wall 352, a back wall 354, a middle wall 356, and a side wall 359.

In some implementations, the back wall 354 of the soap-holding apparatus 300 may include a reinforced hole 384. The reinforced hole 384 may serve a similar purpose to the reinforced hole 484 in the soap-holding apparatus 200, providing a means for hanging and storage.

The soap-holding apparatus 300 may incorporate a sponge 362 adjacent or within the first pocket 320. The sponge 362 may be designed to retain soap that may be released during washing. In some cases, the sponge 362 may release the retained soap through compression, potentially extending the usable life of the bar of soap and improving lathering efficiency.

Figure 5A:
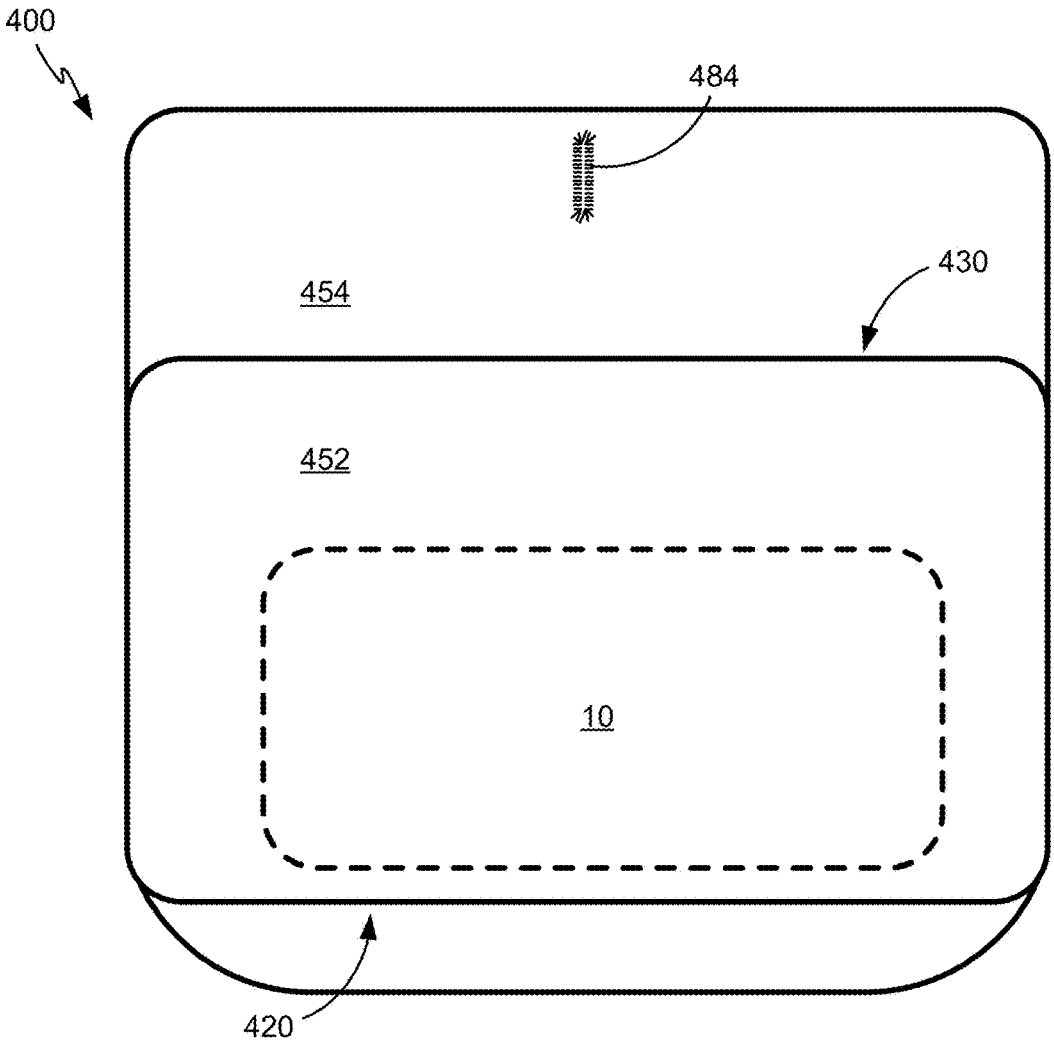
FIGS. 5A-5B illustrate another alternative soap-holding apparatus.
Figure 5B:
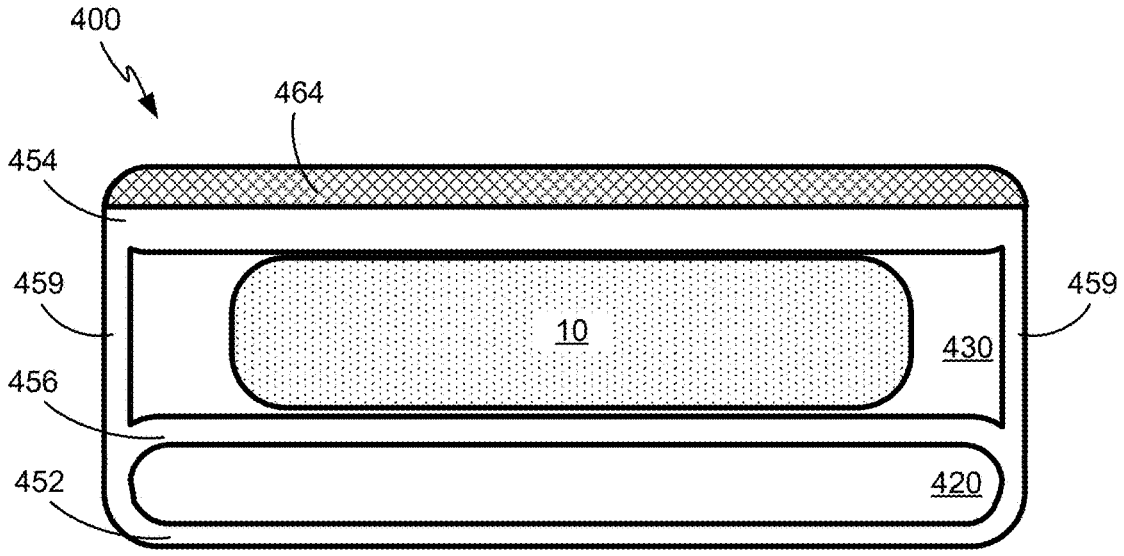

FIGS. 5A-5B depict orthogonal views of a soap-holding apparatus 400, which may represent another alternative configuration. The soap-holding apparatus 400 may include a first pocket 420 and a second pocket 430. These pockets may be formed by a front wall 452, a back wall 454, a middle wall 456, and a side wall 459.

In some implementations, the back wall 454 of the soap-holding apparatus 400 may include a reinforced hole 484, similar to the previously described configurations. Additionally, the soap-holding apparatus 400 may feature an abrasive pad 464 attached to an outer surface of the apparatus 400, such as the back wall 454. The abrasive pad 464 may allow for scrubbing and may support skin exfoliation during washing.

The various configurations of the soap-holding apparatus (200, 300, 400) may offer different benefits and use cases. For example, the button 282 and hook and loop fastener 222 in the soap-holding apparatus 200 may provide easier access to the soap and more secure closure. The sponge 362 in the soap-holding apparatus 300 may enhance soap retention and lathering. The abrasive pad 464 in the soap-holding apparatus 400 may offer additional functionality for skin exfoliation.

In some cases, users may choose between these configurations based on their specific needs and preferences. For instance, individuals seeking enhanced exfoliation may prefer the soap-holding apparatus 400 with the abrasive pad 464. Those looking for improved soap efficiency might opt for the soap-holding apparatus 300 with the sponge 362.

The alternative configurations and additional features described may enhance the versatility and functionality of the soap-holding apparatus, potentially catering to a wider range of user needs and preferences in personal hygiene routines.

The soap-holding apparatus 100 may be constructed from a permeable material that allows water and soap to pass through during use. In some cases, the permeable material may be a terry cloth. The washcloth 150 used to form the soap-holding apparatus 100 may comprise this permeable material, providing the desired characteristics for effective use.

In some aspects, the permeable fabric used for the soap-holding apparatus may comprise a variety of materials beyond terry cloth.

Microfiber may be used as a permeable fabric for the soap-holding apparatus. Microfiber typically consists of very fine synthetic fibers, often a blend of polyester and polyamide. This material may offer excellent water absorption and quick-drying properties, which may be beneficial for maintaining hygiene between uses. The fine fibers of microfiber may also create a soft texture that may be gentle on the skin while still providing effective cleansing.

In some cases, a cotton-polyester blend may serve as an effective permeable fabric for the soap-holding apparatus. This blend may combine the softness and absorbency of cotton with the durability and quick-drying properties of polyester. The ratio of cotton to polyester may be adjusted to optimize the balance between comfort, durability, and functionality.

Bamboo fabric may be another suitable option for the permeable material. Bamboo fibers may offer natural antibacterial properties, which may help prevent the growth of bacteria in the damp environment of a bathroom. Additionally, bamboo fabric may be highly absorbent and may have a silky texture that may be pleasant against the skin.

In some implementations, a mesh fabric may be used for portions of the soap-holding apparatus. Mesh fabrics, which may be made from materials such as nylon or polyester, may offer excellent breathability and may allow for rapid water drainage. This property may be particularly useful in preventing water accumulation within the apparatus, potentially extending the life of the soap and reducing the risk of bacterial growth.

Hemp fabric may also be considered as a permeable material for the soap-holding apparatus. Hemp may offer natural antimicrobial properties and may be highly durable. The texture of hemp fabric may provide a mild exfoliating effect, which may be desirable for some users.

In some aspects, a layered fabric construction may be employed. For example, a layer of absorbent material may be combined with a layer of quick-drying mesh. This combination may allow for effective soap lathering while also promoting rapid drying of the apparatus between uses.

The washcloth 150 of the soap-holding apparatus 100 may be formed from the permeable material. This construction may allow water to penetrate the apparatus 100 and interact with a bar of soap 10 contained within the first pocket 120. The permeable nature of the material may facilitate the creation of lather and the distribution of soap during washing.

In some implementations, the permeable material may be a terry cloth. Terry cloth may offer several benefits for use in the soap-holding apparatus 100. Terry cloth typically features loops of fabric that extend from the base material, creating a textured surface. This texture may enhance the soap-holding apparatus 100's ability to generate lather and provide a gentle exfoliating effect during use.

The absorbent properties of terry cloth may allow the soap-holding apparatus 100 to retain some moisture between uses, potentially extending the life of the bar of soap 10 by preventing excessive drying. Additionally, the durability of terry cloth may contribute to the longevity of the soap-holding apparatus 100, withstanding repeated use and washing.

In some cases, the permeable nature of the material may be enhanced by the folded structure of the soap-holding apparatus 100. The multiple layers created by the folds, as illustrated in FIG. 2A, FIG. 2B, and FIG. 2C, may provide additional pathways for water and soap to move through the apparatus 100. This may result in improved lathering and a more efficient washing experience.

The stitch 182, as shown in FIG. 1B, may be designed to maintain the integrity of the soap-holding apparatus 100 while still allowing for permeability. In some implementations, the stitching pattern may be selected to minimize interference with the flow of water and soap through the permeable material.

While terry cloth may be a suitable material for the soap-holding apparatus 100, other permeable materials may also be used. In some cases, microfiber fabrics, cotton blends, or synthetic materials with moisture-wicking properties may be employed. The selection of material may depend on factors such as desired durability, drying time, and texture for lathering and exfoliation.

The permeable nature of the material may also contribute to the functionality of additional features in alternative configurations of the soap-holding apparatus. For example, in some cases, a sponge 362 may be incorporated within the first pocket 320 of a soap-holding apparatus 300. The permeable material surrounding the sponge 362 may allow water to interact with the sponge 362, facilitating the retention and release of soap during use.

Similarly, an abrasive pad 464 may be incorporated into a soap-holding apparatus 400. The permeable material of the apparatus 400 may allow water and soap to reach the abrasive pad 464, enhancing its exfoliating capabilities while still maintaining the overall functionality of the soap-holding apparatus 400.

In some implementations, the permeability of the material may be considered when designing closure mechanisms for the soap-holding apparatus. For instance, a button 282 used to secure flaps may be selected to minimize interference with the material's permeability while still providing effective closure.

The permeable nature of the material used in the soap-holding apparatus 100 may play a crucial role in its functionality, allowing for effective soap use, lathering, and cleaning while providing a comfortable and efficient bathing experience.

Another consideration is the desire to maximize the use of bar soap while minimizing waste. As soap bars diminish in size, small remnants or slivers may be discarded prematurely, leading to unnecessary waste and increased costs for consumers. Furthermore, storing wet bar soap between uses can result in the soap becoming soft or dissolving more quickly, reducing its longevity.

Traditional washcloths or loofahs are often used in conjunction with bar soap to aid in lathering and application. However, these accessories typically do not provide a means for securely holding a bar of soap during use. This can lead to repeatedly picking up and setting down the soap, which may be inconvenient and time-consuming.

Techniques disclosed herein address these challenges associated with using bar soap. Techniques disclosed herein also provide a convenient way to hold and use bar soap while also offering the benefits of a washcloth or similar cleansing aid. Additionally, accessories that can accommodate various sizes of soap bars and potentially extend the usable life of the soap would be advantageous for many consumers.

The disclosed techniques may enhance the bathing experience, promote more efficient use of bar soap, and potentially make personal hygiene routines more accessible for individuals with physical limitations.

In some aspects, the soap-holding apparatus may offer several environmental benefits, particularly in reducing soap waste and extending soap life:

The apparatus may allow users to continue using smaller pieces of soap that might otherwise be discarded. By securely holding these smaller soap remnants, the device may encourage users to utilize the entire bar of soap, potentially reducing waste.

The apparatus may encourage the use of bar soap over liquid soap alternatives, which often come in plastic containers. This shift may contribute to a reduction in plastic waste, as bar soaps typically use minimal, often paper-based packaging.

In some aspects, the durability and reusability of the soap-holding apparatus may reduce the need for disposable washcloths or loofahs, further decreasing waste in personal hygiene routines.

By facilitating the use of smaller soap pieces and extending overall soap life, the apparatus may reduce the frequency of soap purchases. This reduction in consumption may lead to decreased transportation-related emissions associated with soap distribution and purchase.

These environmental benefits may collectively contribute to a more sustainable approach to personal hygiene, aligning with growing consumer interest in eco-friendly products and practices.

The specific techniques for soap holding apparatuses, such as techniques embodied by apparatuses 100, 200, 300, 400 are merely illustrative of the general inventive concepts included in this disclosure as defined by the following claims.

What is claimed is:

1. A soap-holding apparatus comprising:

a washcloth folded to form:

a front half and a back half connected by a first fold;

a left flap formed by a second fold;

a right flap formed by a third fold;

a front flap formed by a fourth fold;

a first pocket configured to hold a bar of soap, the first pocket formed by the front half, left flap, right flap, and front flap;

a second pocket configured to receive a user's hand, the second pocket formed between the front half and the back half, the first pocket and the second pocket being distinct compartments formed by the folded washcloth with the front half completely separating the first pocket from the second pocket; and a stitch securing the left flap, right flap, and front flap together.

2. The soap-holding apparatus of claim 1, wherein the washcloth includes a permeable material forming at least a portion of the first pocket to allow water and soap to pass through during use.

3. The soap-holding apparatus of claim 2, wherein the permeable material comprises a material selected from the group consisting of: microfiber, cotton-polyester blend, bamboo fabric, mesh fabric, hemp fabric, and combinations thereof.

4. The soap-holding apparatus of claim 1, further comprising a reinforced hole near an upper edge of the apparatus for hanging.

5. The soap-holding apparatus of claim 1, further comprising a fastener for securing the bar of soap within the first pocket.

6. The soap-holding apparatus of claim 5, wherein the fastener comprises a hook and loop fastener.

7. The soap-holding apparatus of claim 1, further comprising an abrasive pad attached to an outer surface of the apparatus.

8. The soap-holding apparatus of claim 1, further comprising a sponge disposed within the first pocket for retaining dissolved soap from the bar of soap.

9. The soap-holding apparatus of claim 8, wherein the sponge is removable from the first pocket.

10. The soap-holding apparatus of claim 8, wherein the sponge is integral with the washcloth.

11. The soap-holding apparatus of claim 1, further comprising a reinforced hole in the back half for hanging the apparatus.

12. The soap-holding apparatus of claim 1, further comprising an abrasive pad attached to an outer surface of the back half.

13. The soap-holding apparatus of claim 12, wherein the abrasive pad is removably attached to the outer surface of the back half.

14. The soap-holding apparatus of claim 1, further comprising a sponge adjacent to the first pocket.

15. The soap-holding apparatus of claim 1, wherein the first pocket includes a first opening configured to receive the bar of soap and the second pocket includes a second opening configured to receive the user's hand, the first opening being disposed along a first edge of the soap-holding apparatus and the second opening being disposed along a second edge of the soap-holding apparatus opposite the first edge.

16. The soap-holding apparatus of claim 1, wherein the front flap includes portions of the front half and the back half, wherein the back half is folded over the first pocket and the second pocket with the fourth fold to form the front flap.

* * * * *